US006675487B2

(12) United States Patent
So

(10) Patent No.: US 6,675,487 B2
(45) Date of Patent: Jan. 13, 2004

(54) CAN OPENER

(76) Inventor: Shun So, 2nd Floor, Chuan Yuan Factory Building, 342-344 Kwun Tong Road, Kwun Tong, Hong Kong (HK)

( * ) Notice: Subject to any disclaimer, the term of this patent is extended or adjusted under 35 U.S.C. 154(b) by 39 days.

(21) Appl. No.: 10/061,866

(22) Filed: Jan. 31, 2002

(65) Prior Publication Data

US 2003/0121162 A1 Jul. 3, 2003

(30) Foreign Application Priority Data

Dec. 28, 2001 (GB) ..... 0131041

(51) Int. Cl.[7] ..... B67B 7/46

(52) U.S. Cl. ..... 30/417; 30/418; 30/422; 30/425; 30/427; 220/265

(58) Field of Search ..... 30/417, 418, 422, 30/425, 427; 220/265, 268, 269, 270

(56) References Cited

U.S. PATENT DOCUMENTS

| | | | | | |
|---|---|---|---|---|---|
| 1,698,605 | A | * | 1/1929 | Newkirk | 30/417 |
| 2,255,640 | A | * | 9/1941 | Arnesen | 30/418 |
| 2,556,766 | A | * | 6/1951 | Mathieu | 30/418 |
| RE27,504 | E | * | 10/1972 | Smith | 30/418 |
| 3,719,991 | A | * | 3/1973 | French | 30/417 |
| 4,576,305 | A | * | 3/1986 | Saunders | 220/269 |
| 4,825,554 | A | * | 5/1989 | Koo | 30/417 |
| 5,181,322 | A | | 1/1993 | Koo | |
| 5,347,720 | A | | 9/1994 | Pereira | |
| 5,787,592 | A | * | 8/1998 | Lai | 30/418 |
| 6,058,613 | A | * | 5/2000 | So | 30/418 |
| 6,094,828 | A | * | 8/2000 | Chong | 30/417 |
| 6,101,727 | A | * | 8/2000 | Chong | 30/418 |
| 6,148,527 | A | * | 11/2000 | Pereira | 30/417 |
| 6,182,368 | B1 | * | 2/2001 | So | 30/418 |
| 6,374,502 | B1 | * | 4/2002 | Holcomb et al. | 30/417 |

FOREIGN PATENT DOCUMENTS

| | | | |
|---|---|---|---|
| GB | 1252374 | 11/1971 | |
| GB | 2285789 | 7/1995 | |
| GB | 2334939 | * 8/1999 | B67B/7/72 |
| GB | 2334939 | 9/1999 | |
| GB | 2341378 | 3/2000 | |
| GB | 2356388 | 5/2001 | |

* cited by examiner

*Primary Examiner*—Allan N. Shoap
*Assistant Examiner*—Jason Prone
(74) *Attorney, Agent, or Firm*—Jackson Walker L.L.P.

(57) ABSTRACT

A manually operable can opener includes elongate first and second operating elements pivotally connected to each other intermediate their ends and having first and second handle members respectively. The can opener has a traction wheel rotatably mounted on the first operating element and a cutter blade rotatably mounted at an inclined angle on the second operating element. At least two abutment surfaces provided on the can opener for engagement with the axially outer edge of the rim of a can. The first abutment surface is operatively forward of the cutter blade and the second abutment surface operatively follows the cutter blade. In use the axially outer edge of the rim can convexly deform proximate the cutter blade. The traction wheel has a radial surface with teeth orientated to engage the radially inner surface of the can rim and an axial surface with teeth orientated to engage the axially outer rim of the can.

8 Claims, 7 Drawing Sheets

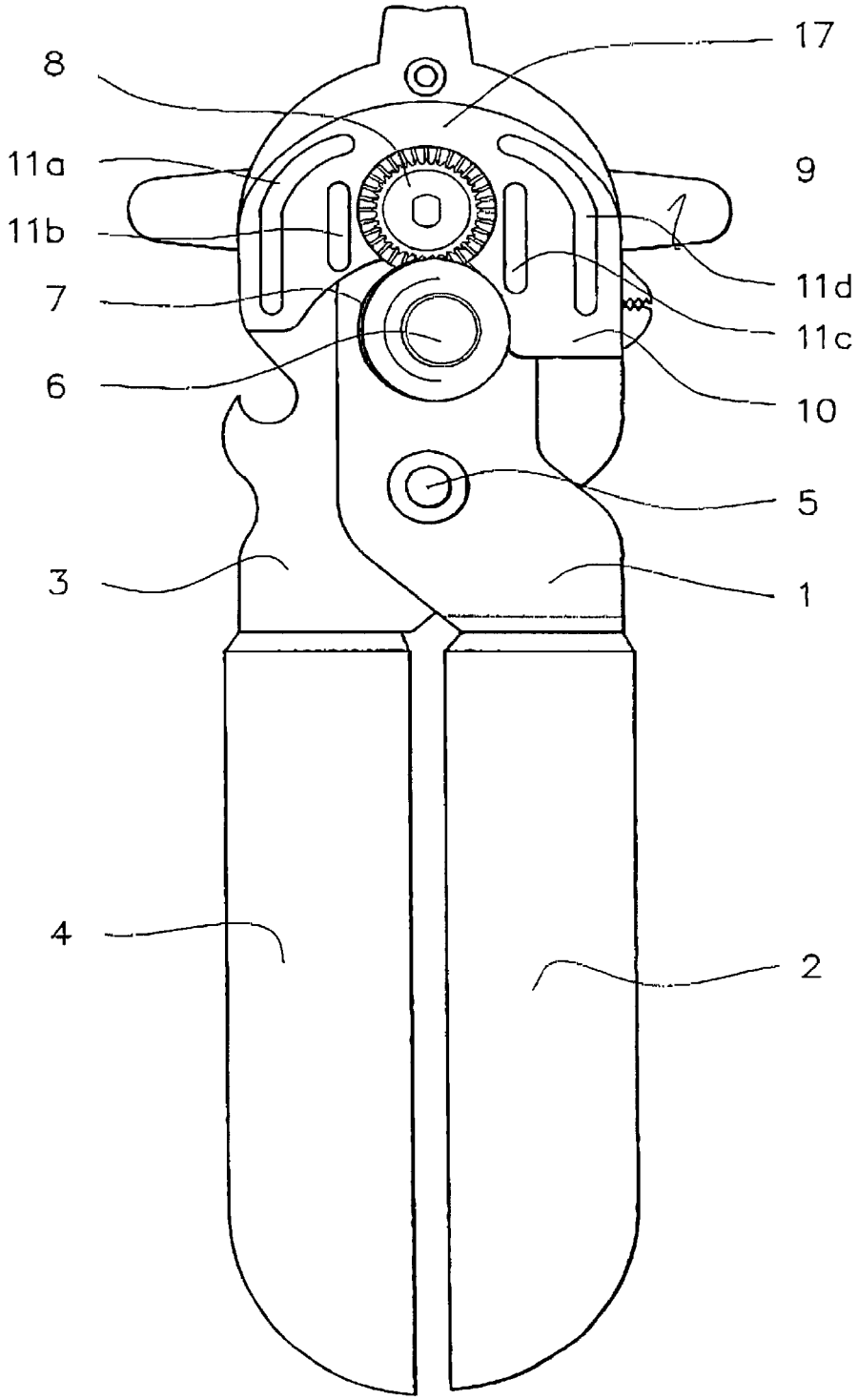
-FIGURE 1-

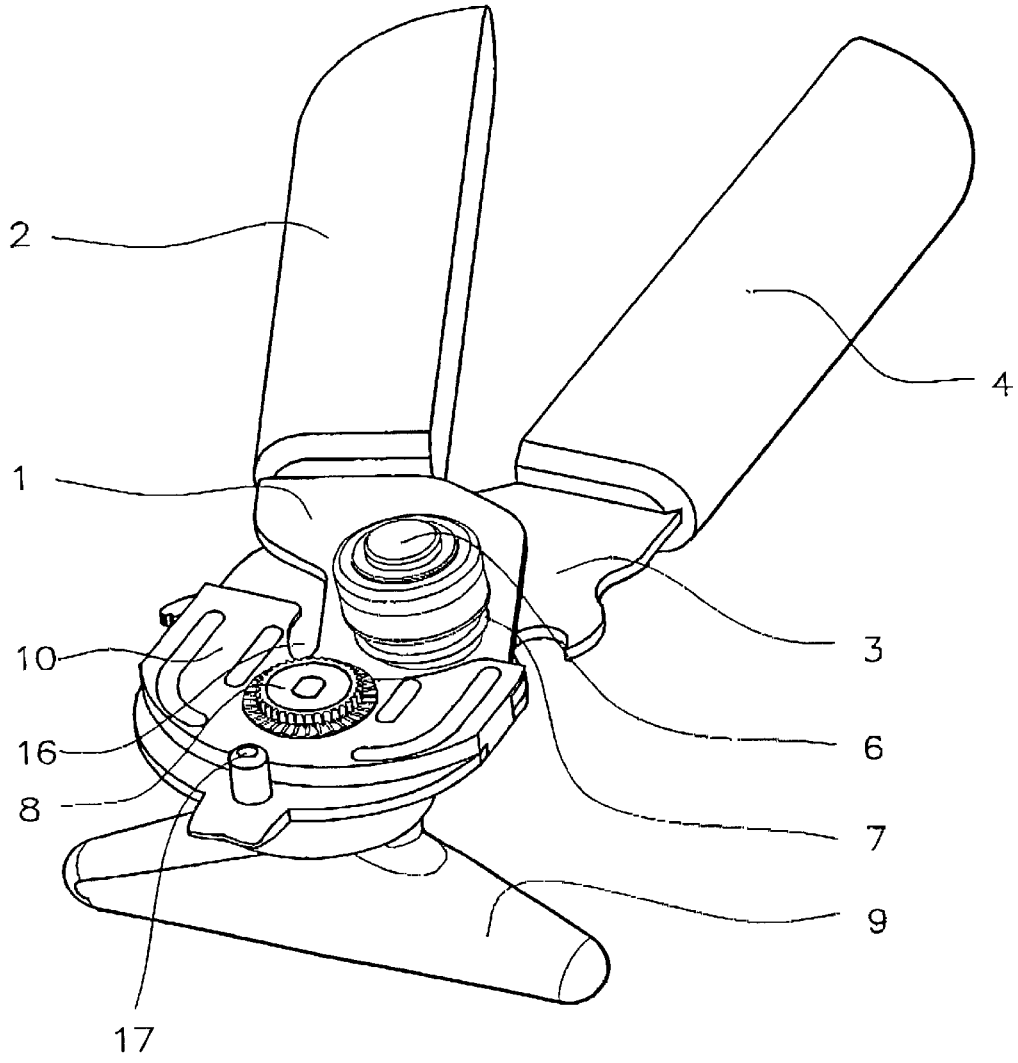
-FIGURE 2-

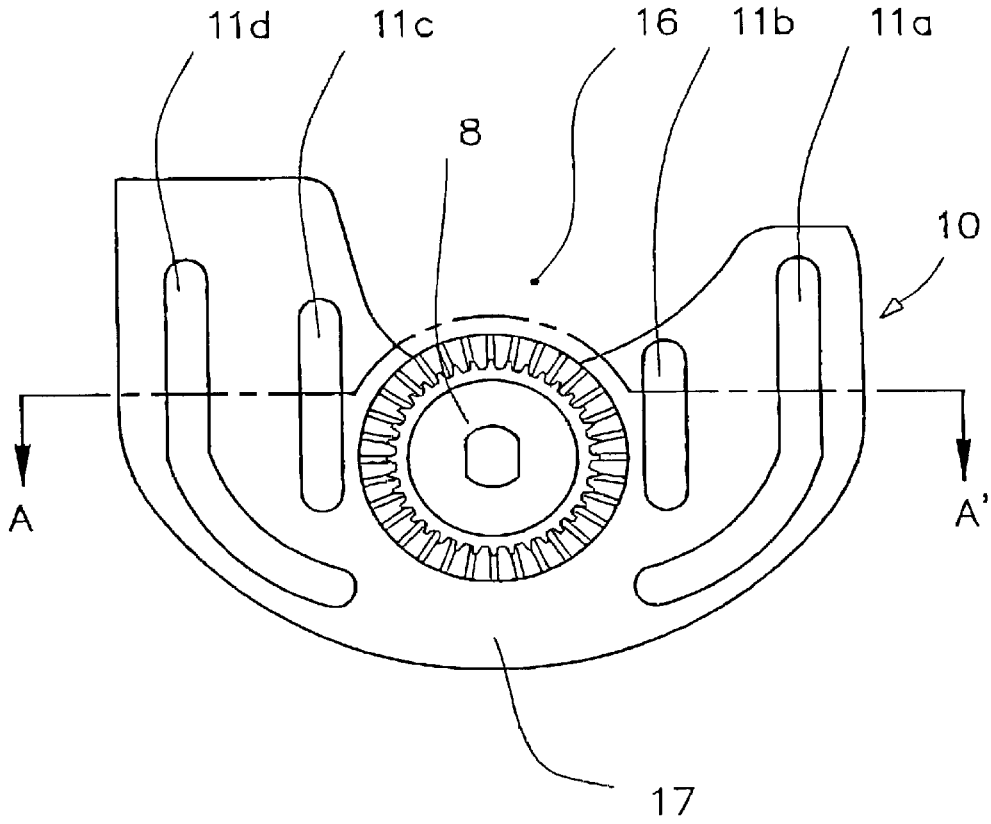
– FIGURE 3 –
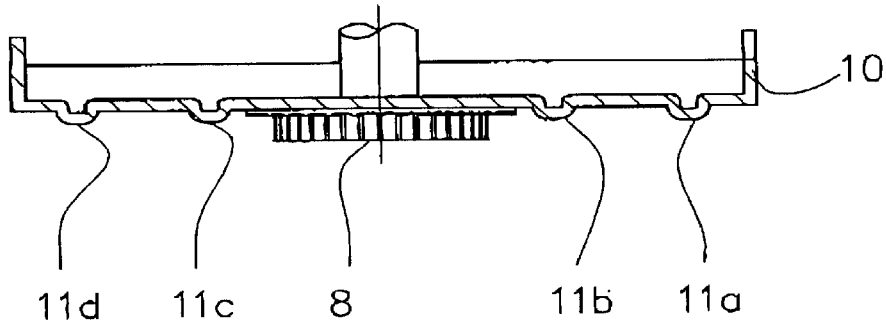
– FIGURE 4 –

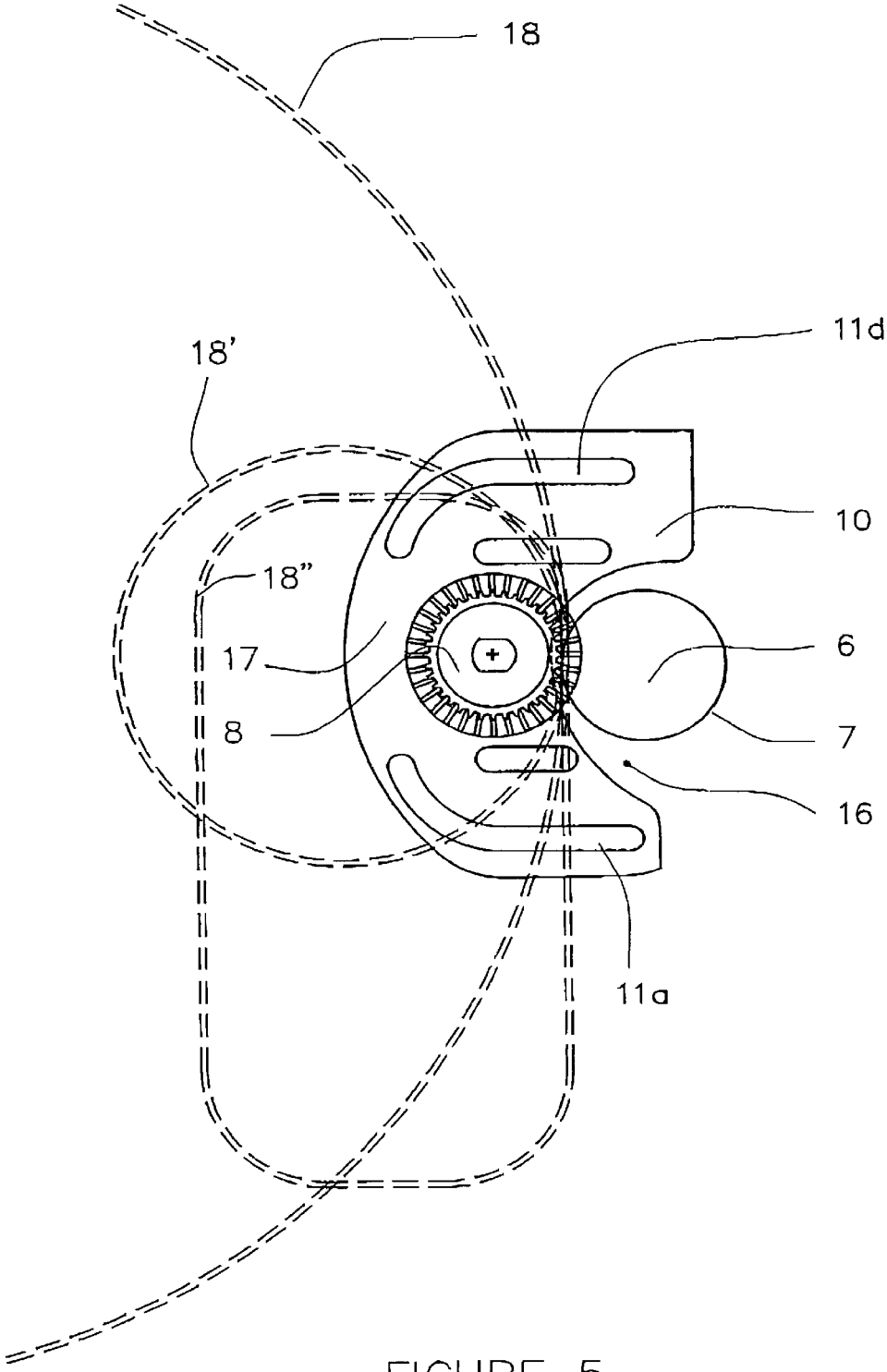
- FIGURE 5 -

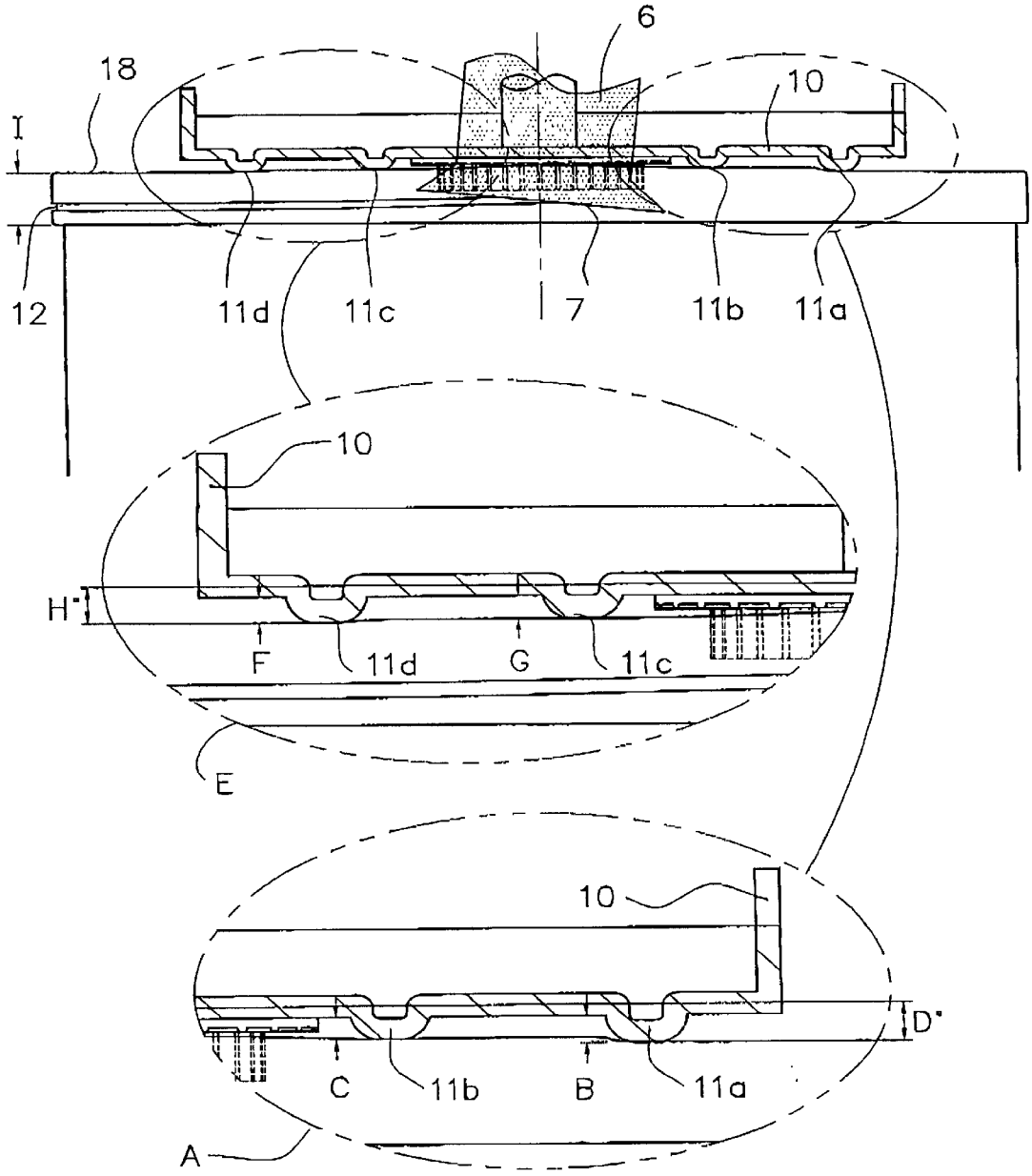
-FIGURE 6-

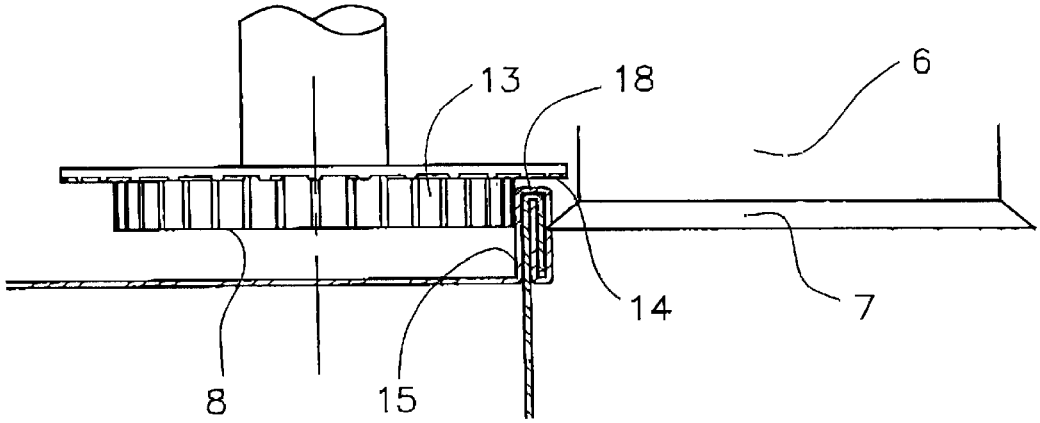
-FIGURE 7-
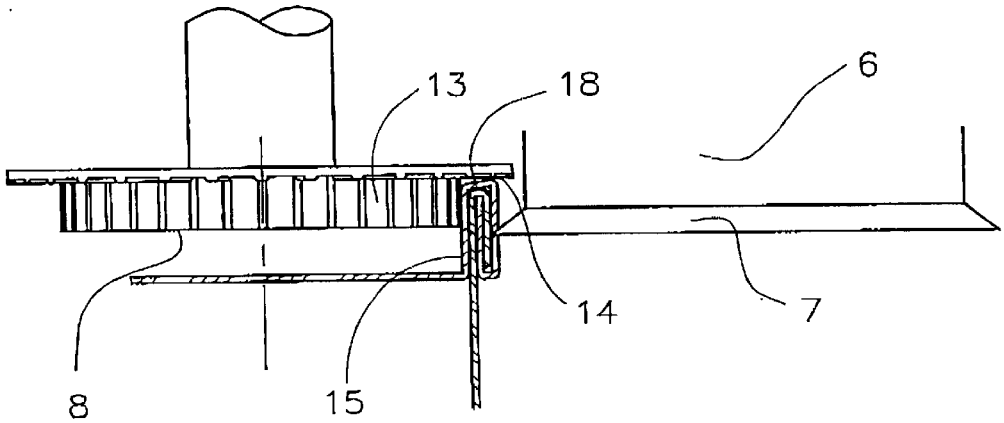
-FIGURE 8-

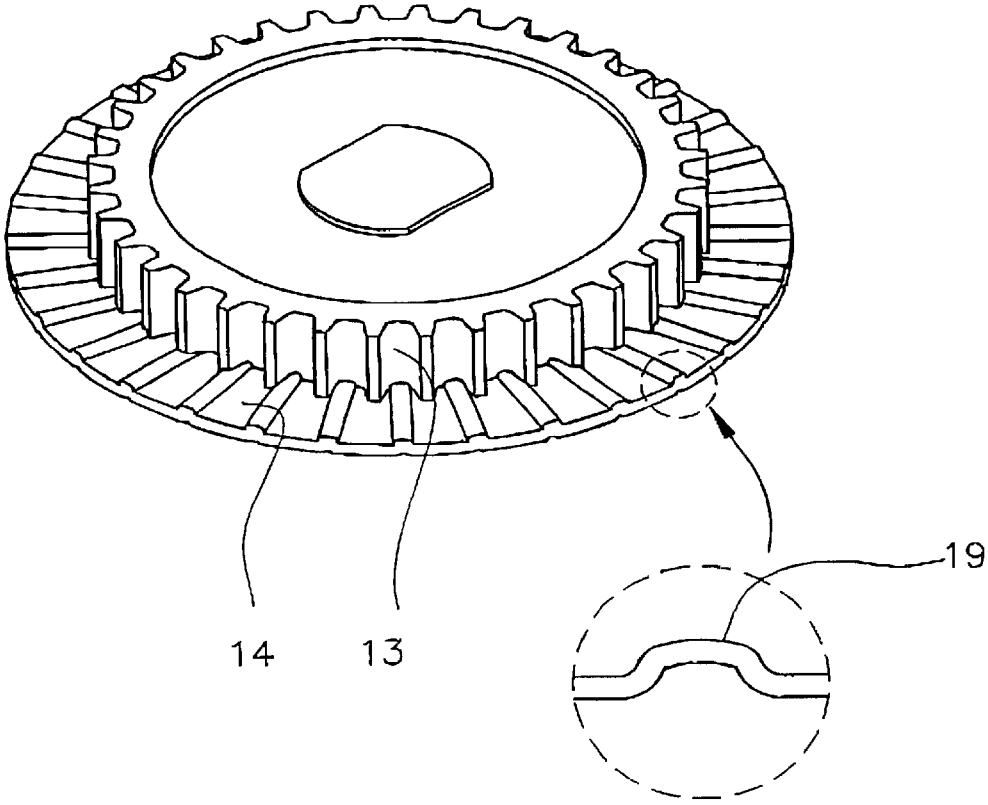
-FIGURE 9-

CAN OPENER

FIELD OF THE INVENTION

The invention relates to manually operable can openers, and in particular to can openers of the laterally-cutting type.

BACKGROUND OF THE INVENTION

Manually operable can openers have been known for many years and may be broadly categorised into three types: a first type having a cutter blade which cuts directly into the top wall of a can, a second type having a cutter blade which cuts into the side wall of the can below the rim, and a third type having a cutter blade which cuts partially into the rim of the can.

The second and third types can be collectively referred to as laterally-cutting types, which are used to remove the end of a can at or below the can rim. Applicant's earlier patents GB 2334939 and GS 2341378 (and corresponding U.S. Pat. No. 6,058,613), the contents of which are considered included as if explicitly set forth herein, describe a can opener that falls into this laterally-cutting type.

Such can openers are advantageous but still present a number disadvantageous. One disadvantage of is stability in maintaining the orientation of the traction wheel and cutter blade relative to the can during the cutting operation. Instability and movement can affect the cutting action, resulting in a rough cut edge and/or lose metal cuttings, and comfort for the user.

A second disadvantage is in maintaining good traction on the can rim during the cutting operation. Known laterally cutting type can openers only have one point of contact between the traction wheel and can rim. During tough cutting operations the traction wheel can slip making it more difficult for the user and further deteriorating the quality of the cut edge of the can.

SUMMARY OF THE INVENTION

It is an object of the present invention to overcome or ameliorate such problems, or at least to provide the public with a useful alternative.

According to a first aspect of the invention there is provided a manually operable can opener including:

elongate first and second operating elements having first and second handle members respectively, said operating elements being pivotally connected to each other intermediate there ends, a traction wheel rotatably mounted on the first operating element and a cutter blade rotatably mounted at an inclined angle on the second operating element, wherein movement of the handles relative each other moves the traction wheel and cutter blade between an inoperative position to receive a rim of a can therebetween and an operative position in which the traction wheel and cutter blade engage the rim of the can, and at least two abutment surfaces provided on the can opener for engagement with the axially outer edge of the rim of the can at circumferentially spaced apart positions, the first abutment surface operatively forward of the cutter blade and the second abutment surface operatively following the cutter blade so that in use the axially outer edge of the rim can convexly deform proximate the cutter blade.

Preferably, the first and second abutment surfaces are oppositely inclined at angles to the plane of the operating elements.

Preferably, the abutment surfaces are ribs, at least two ribs being operatively forward of the cutter blade.

Preferably, the abutment surfaces are ribs, two ribs operatively forward of the cutter blade and two ribs operatively following the cutter blade, the plane engaging the two rib surfaces operatively forward of the cutter blade lying at an angle inclined to the plane of the operating elements and the plane engaging the two rib surfaces operatively following the cutter blade lying at an oppositely inclined angle to the plane of the operating elements.

Preferably, the ribs are formed on a cover plate disposed on the can opener in fixed proximity to the traction wheel.

Preferably, portions of the abutment surfaces extend curvidly to a position proximate the distal ends of the operating elements.

Preferably, the can opener is of the laterally-cutting type.

According to a second aspect of the invention there is provided a manually operable can opener including:

elongate first and second operating elements having first and second handle members respectively, said operating elements being pivotally connected to each other intermediate there ends, a traction wheel rotatably mounted on the first operating element and a cutter blade rotatably mounted at an inclined angle on the second operating element, wherein movement of the handles relative each other moves the traction wheel and cutter blade between an inoperative position to receive a rim of a can therebetween and an operative position in which the traction wheel and cutter blade engage the rim of the can, and wherein the traction wheel has a radial surface with teeth orientated to engage the radially inner surface of the can rim and an axial surface with teeth orientated to engage the axially outer rim of the can.

The can opener may further include at least two abutment surfaces for engagement with the axially outer edge of the rim of the can at circumferentially spaced apart positions, the first abutment surface operatively forward of the cutter blade and the second surface operatively following the cutter blade so that in use the axially outer edge of the rim can convexly deform proximate the cutter blade, the axial surface of the traction wheel engaging the axially outer rim of the can at the convexly deformed apex.

According to a third aspect of the invention there is provided a manually operable can opener including:

elongate first and second operating elements having first and second handle members respectively, said operating elements being pivotally connected to each other intermediate there ends, a traction wheel rotatably mounted on the first operating element, the traction wheel having a radially toothed surface and an axially toothed surface, a cutter blade rotatably mounted at an inclined angle on the second operating element, and at least two abutment surfaces for engagement with the axially outer edge of a rim of a can at circumferentially spaced apart positions, the first abutment surface operatively forward of the cutter blade and the second surface operatively following the cutter blade, the first and second abutment surfaces being oppositely inclined at angles to the plane of the operating elements.

Preferably, the can opener is of the lateral cutting type.

Further aspects of the invention will become apparent from the following description, which is given by way of example only.

BRIEF DESCRIPTION OF DRAWINGS

Embodiments of the invention will now be more particularly described, by way of example only, with reference to the accompanying drawings, in which:

FIG. 1 illustrates a preferred embodiment of a can opener according to the invention.

FIG. 2 is a perspective view of the can opener

FIG. 3 illustrates the over plate of the can opener.

FIG. 4 is a section view through A—A' in FIG. 3.

FIG. 5 illustrated the can opener in relation to a number of typical can shapes.

FIG. 6 illustrates the can opener operative position on a can rim.

FIG. 7 is a first illustration of the can opener cutting action on the can rim.

FIG. 8 is a second illustration of the can opener cutting action on the can rim FIG. 9 illustrates a traction wheel according to the invention.

DETAILED DESCRIPTION OF THE PREFERRED EMBODIMENTS

In a preferred embodiment the invention is a can opener of the laterally-cutting type.

Referring firstly to FIGS. 1 and 2 of the drawings, there shown is a can opener comprising a first operating element 1 extending to a first handle member 2 and a second operating element 3 extending to a second handle member 4. The first and second operating elements 1 and 3 are pivotally connected together intermediate their ends by a pivot pin 5. Pivotally mounted at an inclined angle opposite first handle member 2 of element 1 is a cutter mechanism 6 having a cutter blade 7, Pivotally mounted opposite second handle member 4 of element 3 is a traction wheel 8. The arrangement is such that pivotal movement of handles 2 and 4 relative each other varies the distance between cutter blade 7 and traction wheel 8 from an inoperative position in which the can opener can receive a rim of a can and an operative position in which the traction wheel 8 and cutter blade 7 engage the rim of the can.

An operating handle 9 is axially connected to traction wheel 8 and operable to rotate traction wheel 8.

In use the rim of the can to be opened (not shown) is located between the traction wheel 8 and cutter blade 7, and the handle members 2 and 4 brought together to move the traction wheel 8 and cutter blade 7 to the operative position. Traction wheel 8 engages the inner radial surface of the can rim and the cutter blade 7 engages the outer radial surface of the can rim. The operating handle 9 is rotated, turned, to rotate the traction wheel 8.

This causes the rim to move and the cutter blade 7 to cut through at least the outer radial surface of the can rim. The operating handle 9 is turned ea that the can to be opened rotates through 360° and the circumference of the outer radial surface of the rim is cut by the cutter blade 7. The can end can be removed from the can.

A can opener according to the above description is more fully described in Applicant's United Kingdom Patent numbers GB 2 334 939 and GE 2 341 378, and corresponding U.S. Pat. No. 6,058,613.

Disposed proximate the traction wheel 8 and cutter blade 7, and in fixed relation to operating element 3 and the traction wheel 8, is a cover plate 10. Provided on cover plate 10 are four ribs 11A, 11B, 11C, 11D. Cover plate 10 has an aperture therein (not shown) so that traction wheel 8 can be rotatably mounted therethrough. The cover plate 10 is shown in more detail in FIGS. 3 and 4. A concave portion 16 allows cutter blade 7 to be movably between the inoperative position and operative position proximate the traction wheel 8.

Two ribs are provided either side of the traction wheel 8 and cutting blade 7 to provide two abutment surfaces. The first abutment surface, comprising ribs 11A and 11B, is operatively forward of the cutter wheel 7 and the second abutment surface, comprising ribs 11C and 11D, is operatively following the cutter wheel. Portions of the two outer most ribs 11A and 11D extend curvidly to a position proximate the distal end 17 of the cover plate 10 and thus operating elements. This allows the can opener to be used with different shapes and configurations of cans as shown by the dashed lines 18, 18', and 18" in FIG. 5.

Referring to FIG. 6, in use the ribs, or abutment surfaces, bear against the axially outer edge 18 of the can rim thereby enhancing maintenance of the orientation of the traction wheel 8 and the cutter blade 7 relative to the can. One novel feature of the invention is that the first and second abutment surfaces are oppositely inclined at angles to the plane of the operating elements 1 and 3.

Detail section A of FIG. 6 shows the first abutment surface comprising ribs 11A and 11B operatively forward of the cutter blade 7. By providing rib 11A to have a height B greater than height C of rib 11B the plane formed across the surfaces of the two ribs is inclined at an angle D degrees to the plane of the operating elements 1 and 3.

Detail section E of FIG. 6 shows the second abutment surface comprising ribs 11C and 11D operatively following the cutter blade 7. On this side of the cutter blade 7 rib 11D has a height F greater than height G of rib 11C so that the plane across the rib surfaces is oppositely inclined at an angle H degrees to the plane of the operating elements 1 and 3.

Immediately proximate the cutter blade 7 there is no contact between the abutment surfaces and the axially outer edge 18 of the can rim so that in use the outer edge 18 of the can rim can convexly deform proximate the cutter blade 7. The oppositely inclined abutment surfaces follow the convexly deformed edge 18. The reason for the convex deformation of the can rim is that the outer radial skin of the can rim is deform upwardly when it is pierced by the cutter blade 7. This is illustrated in FIG. 8

Operatively following the cutter blade 7 the outer radial surface of the can rim has a cut 12. This increases the axial diameter I of the can rim in the area operatively following the cutter blade 7. For this reason angle H degrees of the second abutment surface is smaller than angle D of the operatively forward abutment surface.

Referring to FIGS. 7 to 9, another novel feature of the invention is that traction wheel 8 has two traction surfaces. A first traction surface 13 is orientated to engage the radially inner a surface 15 of the can rim and a second surface 14 is oriented to engage the axial outer rim or edge 18 of the can when an use. The two surfaces 13 and 14 are provided with teeth or serrations 19 of substantially equal radius for gripping the can rim surfaces 15 and 18.

With reference to FIG. 7, prior to the cutter blade 7 and traction wheel 8 moving to the operative position, where the cutter blade 7 pierces the outer skin of the can rim, the second surface 14 of traction wheel 8 does not engage the rim edge 18. When the rim is deform convexly by penetration of cutter blade 7 the upward movement engages surface 14 of the traction wheel 8 wheel against the can rim edge 18. The two contact surfaces on the can rim provide additional traction for movement of the can rim when operating handle 9 is rotated.

The invention has been given by way of example only, and various other modifications of and/or alterations to the described embodiments may be made by persons skilled in the art without departing from the scope of the invention as specified in the appended claims.

What I claim is:

1. A manually operable can opener including:

elongate first and second operating elements having first and second handle members respectively, said operating elements being pivotally connected to each other intermediate their ends, a traction wheel rotatably mounted on the first operating element and a cutter blade rotatably mounted at an inclined angle on the second operating element, wherein movement of the handles relative each other moves the traction wheel and cutter blade between an inoperative position to receive a rim of a can therebetween and an operative position in which the traction wheel and cutter blade engage the rim of the can, and a plate having at least two protruding ribs extending curvedly to a position proximate distal ends of the operating elements for engagement with an axially outer edge of the rim of the can at circumferentially spaced apart positions, the first rib operatively forward of the cutter blade and the second rib operatively following the cutter blade so that in use the axially outer edge of the rim can convexly deforms proximate the cutter blade.

2. A can opener as claimed in claim 1 wherein surfaces of the ribs are oppositely inclined at angles to a plane of the operating elements.

3. A can opener as claimed in claim 1 wherein the two ribs are operatively forward of the cutter blade.

4. A can opener as claimed in claim 1 wherein the two ribs are operatively forward of the cutter blade and a further two ribs are operatively following the cutter blade, a first plane engaging surfaces of the two ribs operatively forward of the cutter blade lying at an angle inclined to a plane of the operating elements and a second plane engaging surfaces of the further two ribs operatively following the cutter blade lying at an oppositely inclined angle to the plane of the operating elements.

5. A can opener as claimed in claim 1 which is of a laterally-cutting type.

6. A manually operable can opener including:

elongate first and second operating elements having first and second handle members respectively, said operating elements being pivotally connected to each other intermediate their ends, a traction wheel rotatably mounted on the first operating element and a cutter blade rotatably mounted at an inclined angle on the second operating element, wherein movement of the handles relative each other moves the traction wheel and cutter blade between an inoperative position to receive a rim of a can therebetween and an operative position in which the traction wheel and cutter blade engage the rim of the can, a plate having at least two protruding ribs extending curvedly to a position proximate distal ends of the operating elements for engagement with an axially outer edge of the rim of the can at circumferentially spaced apart positions, and wherein the traction wheel has a radial surface with teeth oriented to engage a radially inner surface of the can rim and an axial surface with teeth oriented to engage an axially outer edge of the rim of the can.

7. A can opener as claimed in claim 6 wherein the first rib is operatively forward of the cutter blade and the second rib is operatively following the cutter blade so that in use the axially outer edge of the rim can convexly deforms proximate the cutter blade, the axial surface of the traction wheel engaging the axially outer rim of the can.

8. A manually operable can opener including:

elongate first and second operating elements having first and second handle members respectively, said operating elements being pivotally connected to each other intermediate their ends, a traction wheel rotatably mounted on the first operating element, the traction wheel having a radially toothed surface and an axially toothed surface, a cutter blade rotatably mounted at an inclined angle on the second operating element, and a plate having at least two protruding ribs extending curvedly to a position proximate distal ends of the operating elements for engagement with an axially outer edge of a rim of a can at circumferentially spaced apart positions, the first rib operatively forward of the cutter blade and the second rib operatively following the cutter blade, surfaces of the ribs being oppositely inclined at angles to a plane of the operating elements.

* * * * *